US006692001B2

(12) United States Patent
Romano

(10) Patent No.: US 6,692,001 B2
(45) Date of Patent: Feb. 17, 2004

(54) MULTI-LAYERED DECORATIVE PUZZLE APPARATUS

(76) Inventor: Julio C. Romano, 6641 Feldspar, Houston, TX (US) 77092

( * ) Notice: Subject to any disclaimer, the term of this patent is extended or adjusted under 35 U.S.C. 154(b) by 0 days.

(21) Appl. No.: 10/042,467

(22) Filed: Jan. 10, 2002

(65) Prior Publication Data

US 2003/0127794 A1 Jul. 10, 2003

(51) Int. Cl.[7] ..... A63F 9/12
(52) U.S. Cl. ..... 273/157 A; 273/156; 446/219
(58) Field of Search ..... 273/153 R, 156, 273/157 R, 157 A, 153 S, DIG. 24; 446/219

(56) References Cited

U.S. PATENT DOCUMENTS 2,493,697 A * 1/1950 Raczkowski ..... 273/156
3,610,628 A * 10/1971 Promin ..... 273/138.4
4,286,780 A * 9/1981 Vermeire ..... 472/57
4,360,347 A * 11/1982 Ghaznavi ..... 434/198
4,600,974 A * 7/1986 Lew et al. ..... 362/102
5,788,232 A * 8/1998 Binkley ..... 273/155
5,806,853 A * 9/1998 Druckman et al. ..... 273/156
6,209,720 B1 * 4/2001 Chen ..... 206/315.1
6,305,808 B1 * 10/2001 Ochi ..... 359/616

* cited by examiner

*Primary Examiner*—Kien T. Nguyen

(57) ABSTRACT

A multilayered decorative puzzle apparatus constructed into a three dimensional geometric structure. The puzzle apparatus further includes an innermost and an outermost layer. Each layer further comprises a set of puzzle pieces which are arranged around a rod securely attached to the center of a base. The base supports the constructed geometric structure. A cover is provided to encompass and protect the constructed geometric structure.

44 Claims, 6 Drawing Sheets

MULTI-LAYERED DECORATIVE PUZZLE APPARATUS

BACKGROUND

This invention relates to the art of puzzles and more particularly relates to three-dimensional puzzles having a plurality of components that assemble to form a geometric structure. Three-dimensional puzzles have been around for several years. A number of three-dimensional puzzles are available in the prior art including the following:

1. U.S. Pat. No. 4,397,466, Nicholls, discloses a manipulative disk puzzle comprising three identically shaped pieces that inherit to form a geometric solid.
2. U.S. Pat. No. 4,522,404, Di Gregorio, discloses a simple puzzle structure whereby a very high number of three-dimensional configurations can be obtained.
3. U.S. Pat. No. 5,299,805, Green, discloses a multilayered puzzle having a plurality of superposable card units whereby the rotation of the card units forms a large number of pattern combinations.

Although various three-dimensional puzzles have been available in the prior art, it would still be desirable to have a three-dimensional puzzle that is mentally challenge and that becomes a decorative novelty item upon completion.

SUMMARY

The present invention provides a multilayered three dimensional decorative puzzle apparatus that can be used as a novelty item. The puzzle apparatus comprises an innermost layer and an outermost layer constructed into a geometric structure. Each layer further includes a set of puzzle pieces. The puzzle apparatus further includes a base with an elongated rod securely attached to the center of the base. The innermost layer puzzle pieces are seated upon the rod and the outermost layer puzzle pieces are seated upon the innermost layer puzzle pieces. The constructed geometric structure sits upon the top surface of the base. The set of puzzle pieces and the rod can be of a transparent or translucent material A cover is provided to encompass and to protect the constructed geometric structure. A rotating means is provided to rotate the base around a turntable to create an aesthetic lighting effect as a neon light situated within the rod illuminates through the rod and into the layers of the puzzle apparatus.

DRAWINGS

The embodiments of the invention will be particularly described, by way of example, with reference to the accompanying diagrammatic drawings, in which.

DETAILED SPECIFICATION

Figure 1:
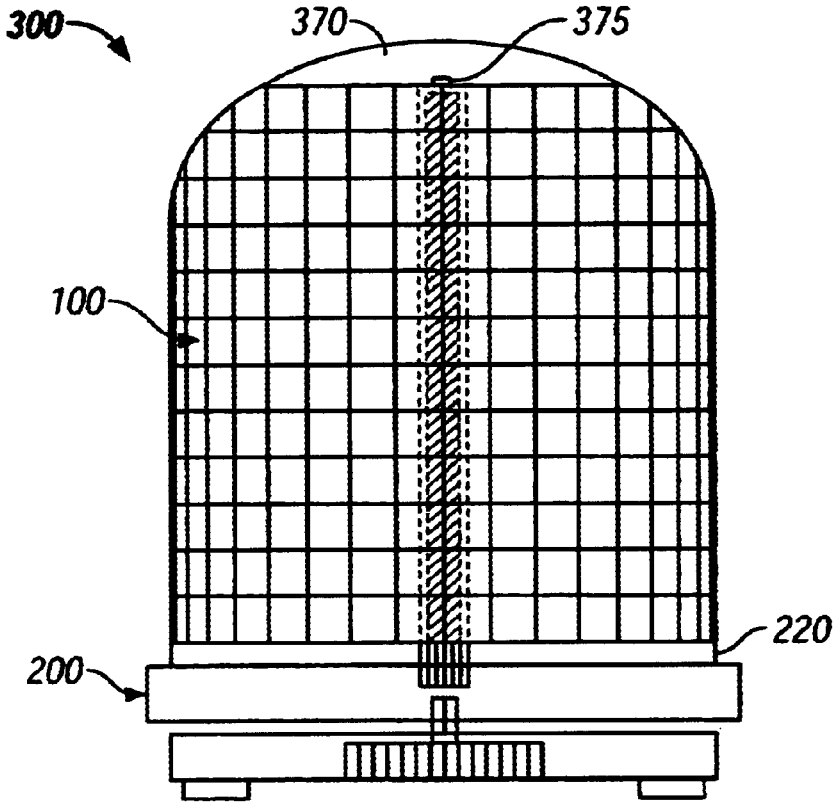
FIG. 1 is an overall perspective view of one embodiment of the present invention.

Referring now to FIG. 1, an overall perspective view of one embodiment of the present invention is seen, a three dimensional multilayered puzzle constructed into a geometric structure (100). In the illustrated embodiment, geometric structure (100) is supported by base (200). In this kind of embodiment, base (200) is constructed with enough area volume to support the size and shape of the constructed geometric structure. To protect the constructed geometric structure (100), cover (300) completely encloses geometric structure (100) and sits upon the top surface of base (200).

Figure 2A:
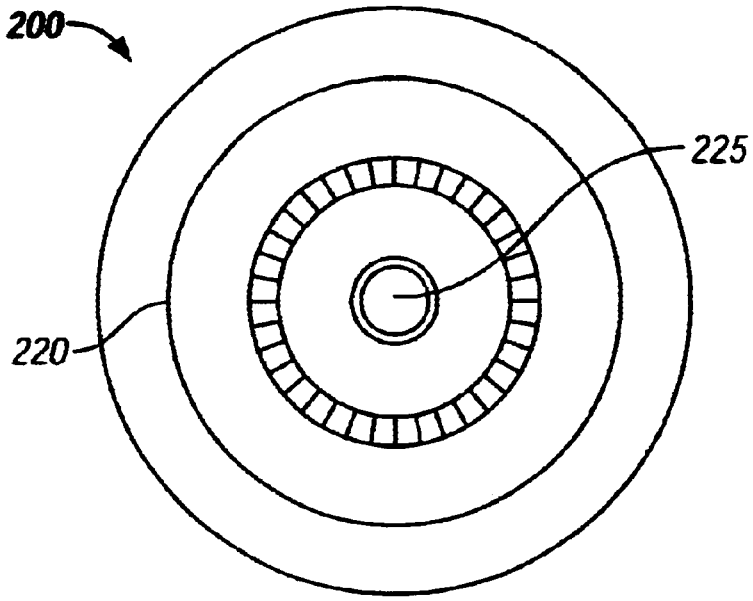
FIG. 2A illustrates a cross-sectional top view of the base of the present invention.

Referring now to FIG. 2A, there is shown an exploded top view of base (200). In the illustrated embodiment, base (200) has a circular shape with a groove (220) engraved along the outer peripheral edge of the circumference of base (200). Rod (225) is located in the center of base (200) with groove (220) concentrically located around rod (220). Base (200) can be made of a solid material such as wood, plastic, or other type of suitable material.

Referring back to the illustrated embodiment in FIG. 1, cover (300) is dome shaped with a circular shaped edge corresponding to the size and shape of groove (220). In this embodiment, the pattern of the groove (220) on the top surface of base (200) is cut to match the circular shaped edge of cover (300). In order for cover (300) to be held in a stationary position, the circular shaped edge is securely placed within groove (220). Additionally, cover (300) can be made of a transparent material, for example, clear plastic or such type of suitable material.

In alternative embodiments of the present invention, the size and shape of the base (200), groove (220), and cover (300) may vary. The frame of cover (300) must have enough volume to encompass the constructed geometric structure (100). The edge of cover (300) should match the outline of groove (220). The base (200) is constructed with enough area to support the constructed geometric structure (100). In alternative embodiments, the cover (300), groove, and base (200) varies to support the constructed geometric structure (100).

Figure 2B:
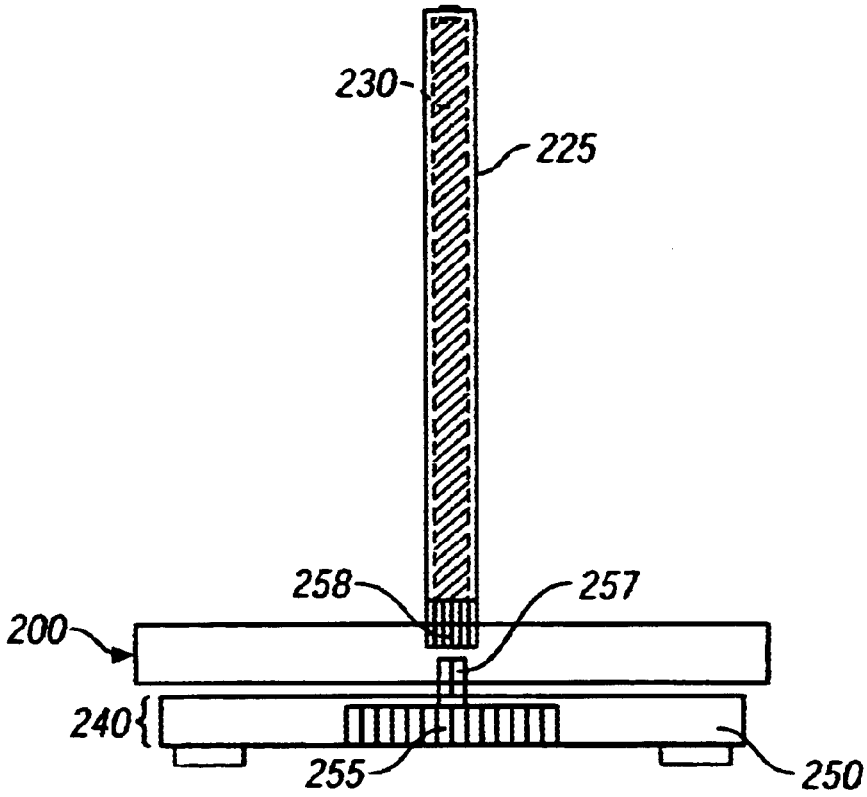
FIG. 2B illustrates a side view of the base and the rod of the present invention.

Referring now to FIG. 2B, there is illustrated a side view of base (200). The illustrated embodiment, further comprises rod (225) having an upper end and a lower end. Rod (225) further includes a mid-section disposed between the upper end and the lower end. The lower end of rod (225) is securely attached to the center of base (200). The height of rod (225) is defined by the height of geometric structure (100). Rod (225) is securely attached to the center of base (200) using a fastener such as a metal or plastic screw or other suitable fasteners. Additionally, rod (225) can be securely attached to the center of base (200) utilizing strong bonding glue. In the illustrated embodiment, rod (225) has an elongated cylindrical shape and can be made of a solid material such as wood or plastic.

Figure 2C:
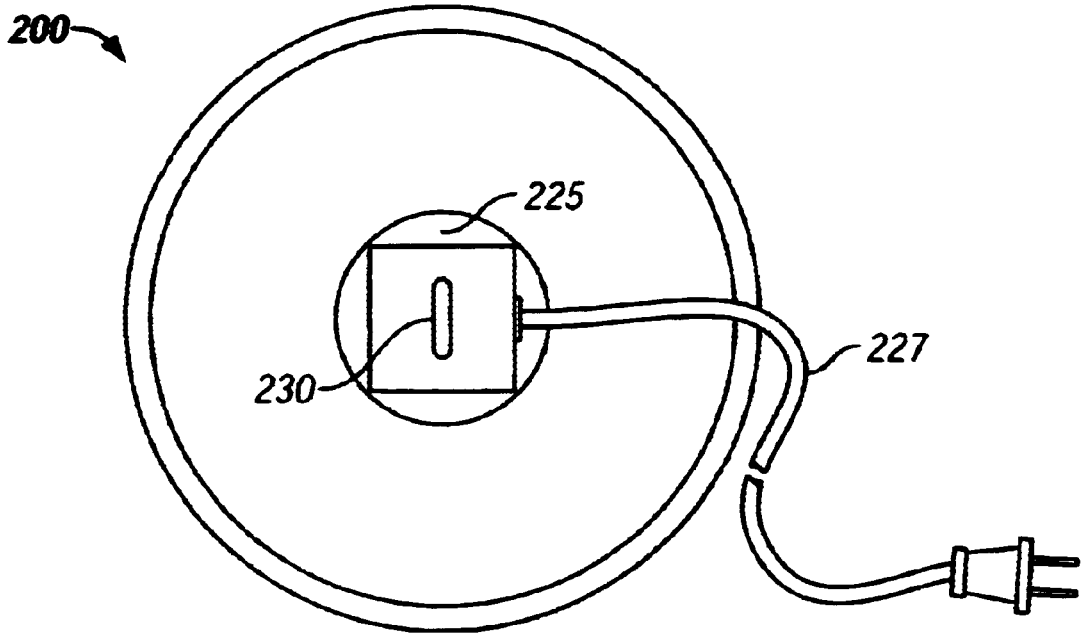
FIG. 2C illustrates a cross-sectional bottom view of the base of the present invention.

In some even more specific embodiments of the present invention, rod (225) can be made of a transparent material such as acrylic. As shown in FIG. 2C, if rod (225) is made of a transparent material, then a neon light (230) connected by conventional electrical means (227) can be situated within rod (225). As illustrated in FIG. 2C, the conventional electrical means (227) can be an electrical cord which can be plug into any conventional socket. Additionally, the electrical means (227) can be batteries. When the neon light is electrically connected, the transparency of rod (225) allows the neon light (230) to illuminate thru the rod (225) into the layers of the constructed geometric structure (100) illustrated in FIG. 1. In alternative embodiments of geometric structure (100), the length and width of rod (225) can also be varied to support the constructed structure.

The embodiment illustrated in FIG. 2B further comprises rotating means (240). In the illustrated embodiment, the rotating means (240) includes turntable (250) with slightly smaller dimensions than base (200) located underneath base (200). As illustrated in FIG. 2B, turntable (250) further comprises knob (255) with peg (257) securely attached to the center of knob (255). Attached beneath rod (225) within base (200) is coupling (258) which is connected to peg (257). In this kind of embodiment, in order for base (200) to rotate in a circular motion, knob (255) is manually turned in either a clockwise or a counter clockwise direction which causes peg (257) to rotate within coupling (258). As peg (257) rotates, coupling (258) turns causing base (200) to rotate in a circular motion. Additionally, rotating means (240) can be made of the same type of material as base (200).

An alternative embodiment for rotating means (240) can be a conventional wind up mechanism stored within turntable (250). Wind up mechanisms are highly utilized in commercially available musical boxes. The mechanism consists of a small knob connected to gears which are connected to peg (257). After the small knob is rotated clockwise several times, the gears cause peg (257) to turn within coupling (258). As peg (257) turns, base (200) rotates in a circular motion. Another alternative embodiment for rotating means (240) can be a conventional small motor stored in turntable (250). The small motor is connected to gears which is connected to peg (257). Upon pressing a switch, which is electrically connected to the small motor, into an on position, the small motor causes the gears to turn which cause peg (257) to turn within coupling (258). The electrical connection can be batteries or a conventional electrical cord plugged into a conventional electrical socket. As peg (257) turns, base (200) rotates in a circular motion.

Figure 3:
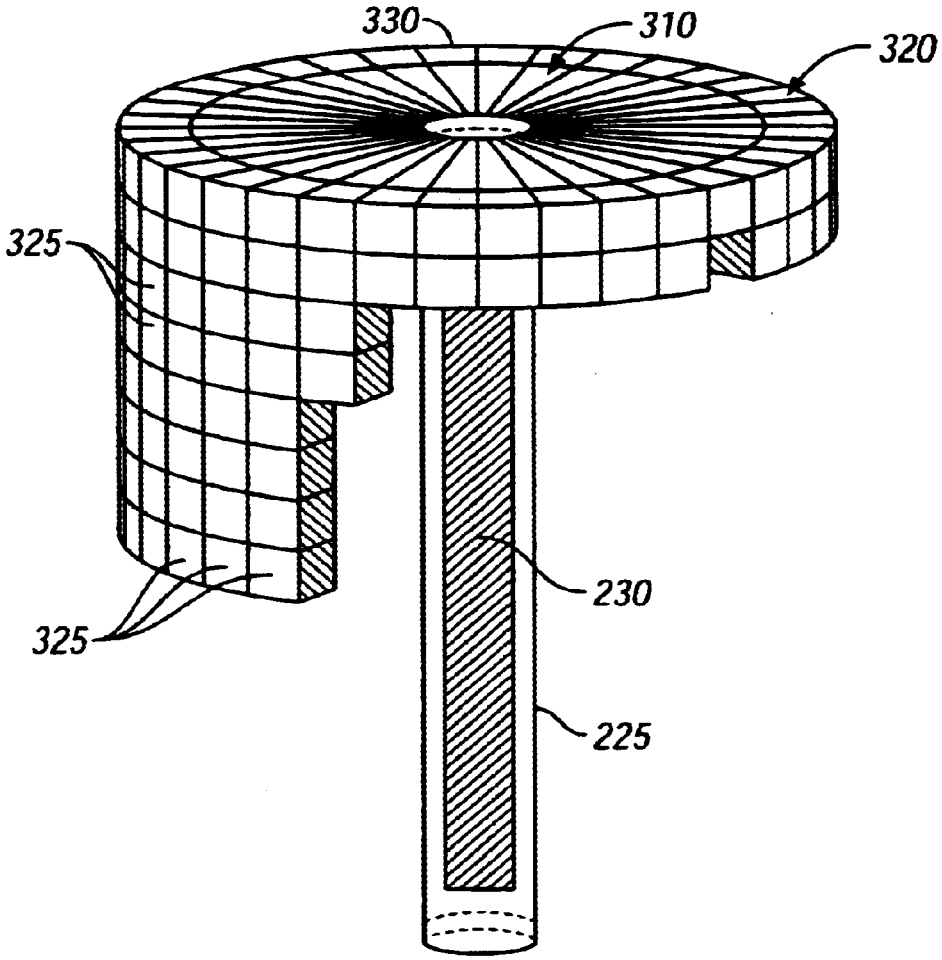
FIG. 3 illustrates a cross-sectional and side view of the geometrical structure formed by the present invention.

Referring now to FIG. 3, there is illustrated a cross-sectional view of constructed geometric structure (100). In the illustrated embodiment, geometric structure (100) further comprises innermost layer (310) and outermost layer (320). Innermost layer (310) is further comprised of a first set of puzzle pieces with each puzzle piece having substantially the same size and shape. Additionally, outermost layer (320) is further comprised of a second set of puzzle pieces with each puzzle piece having substantially the same size and shape. As illustrated in the embodiment shown in FIG. 3, the innermost layer (310) and the outermost layer (320) are arranged into a predetermined geometric shape forming geometric structure (100).

Referring back to FIG. 1, the constructed geometric structure (100) is pod shaped. However, the geometric structure (100) of the present invention is not limited to a pod shape. In alternative embodiments of the present invention, the size and shape of geometric structure (100) can vary. In alternative embodiments of geometric structure (100), the size and the shape of each puzzle piece in the innermost layer (310) and in the outermost layer (320) depicted in FIG. 3 would have to be cut to correspond the alternative embodiment of the predetermined geometric structure (100).

Figure 4:
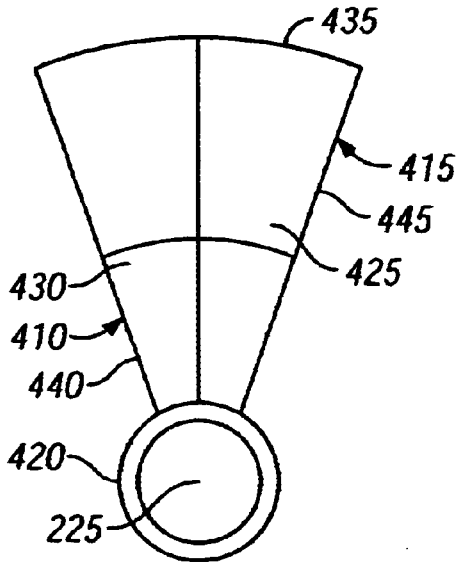
FIG. 4 illustrates an exploded view of an innermost puzzle piece connected to an outermost puzzle piece.

Referring now to FIG. 4, there is illustrated an exploded top view of an innermost layer puzzle piece (410) and an outermost layer puzzle piece (415). Both the innermost layer puzzle piece and the outermost layer puzzle piece are polyhedrons with each piece respectively having front plane (420, 425), rear plane (430, 435) and a plurality of side planes (440, 445). As shown in the illustrated embodiment, front plane(420) of innermost layer puzzle piece (410) has a half-circle recess which is cut to seat upon the mid-section of rod (225). Additionally, front plane (425) of outermost layer puzzle piece (415) has a half-circle recess which is cut to fit upon rear plane (430) of innermost layer puzzle piece (410).

Referring back to FIG. 3, as depicted, each puzzle piece in the innermost layer (310) is seated upon the mid-section of rod (225) and each puzzle piece in the outermost layer (320) is seated upon the back plane of an inner most layer puzzle piece. In alternative embodiments, geometric structure (100) can take on a variety of shapes. In these alternative forms, each innermost puzzle piece would be adapted to seat upon the mid-section of rod (225) and each outer most puzzle piece would be adapted to seat upon the back plane of an innermost layer puzzle piece. Additionally, the configuration of rod (225) would have to be adapted to support alternative geometric forms.

In the illustrated embodiment in FIG. 3, both the innermost layer (310) and the outermost layer (320) can be made of plastic, wood, or other suitable material. In one embodiment of the present invention, both innermost layer puzzle piece (320) and outer most layer (320) can be made of a non-transparent material. In an alternative embodiment of the present invention, both the innermost layer (310) and the outermost layer (320) can be made of a transparent or a translucent material. In yet another embodiment present invention, only the outer most layer (310) is made of a transparent or a translucent material while the innermost layer (320) is made of a non-transparent or non-translucent material. The present invention is flexible enough to allow various arrangements of the innermost and the outermost layers to be created.

In the illustrated embodiment shown in FIG. 3, geometric structure (100) is composed of a plurality of segments (325) spanning the height of rod (225). Each segment further includes an innermost layer section and a corresponding outermost layer section. Additionally, each section of each segment is concentrically located around rod (225).

In order to construct the pod shape geometric structure (100) shown in FIG. 1, each segment starting from the bottom of the base to the top of the rod is arranged into a circular shape geometric figure (330) surrounding rod (225). In this kind of embodiment, the total diameter of each segment from the base to the top of the rod (225) is adapted in size to create the pod shaped structure. In alternative embodiments of geometric structure (100), the diameter of each segment of each layer would have to be adapted to correspond to the shape of the alternative geometric structure.

In the illustrated embodiment in FIG. 3, each segment is constructed starting with the innermost layer section (310) and then the corresponding outermost section (320). In this kind of embodiment, the half-circle recess of each puzzle piece of the innermost layer section (310) is seated upon the mid-section of rod (225). Then, the side planes of each puzzle piece in the innermost layer section (310) are aligned next to each other and stacked into a solid three dimensional circular geometrical structure. Secondly, the half-circle recess of each puzzle piece of the outermost layer section (320) is seated upon the back plane of a puzzle piece of the innermost layer section (310). Then, the side planes of each puzzle piece in the outermost layer section (320) are aligned next to each other and stacked into a solid three dimensional geometrical circular structure. As the innermost section and the outermost section of each segment are constructed the pod shaped geometric structure (100) is formed.

Figure 3A:
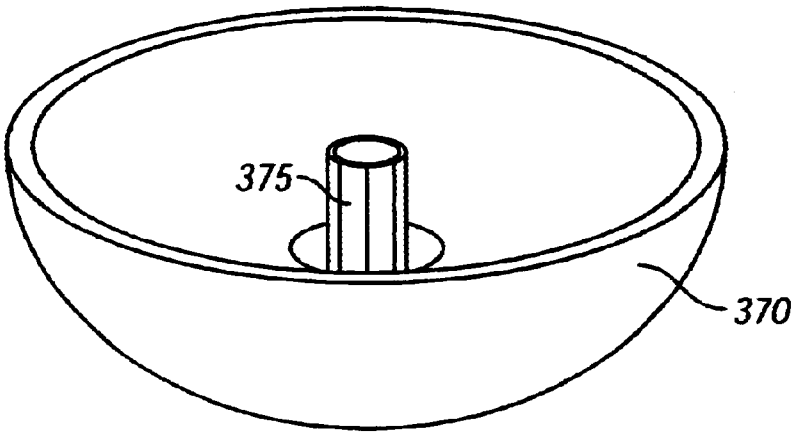
FIG. 3A illustrates a bottom view of the plate member of the present invention.

Referring to FIG. 3A, in an even more specific embodiment of the present invention, geometric structure (100) further includes plate member (370). In the illustrated embodiment, plate member (370) is dome shaped having a support peg (375) securely attached to the center inside of plate member (370). Plate member (370) and support peg (375) can also be made of a translucent or transparent material such as plastic or acrylic or another such type of suitable material.

Figure 3B:
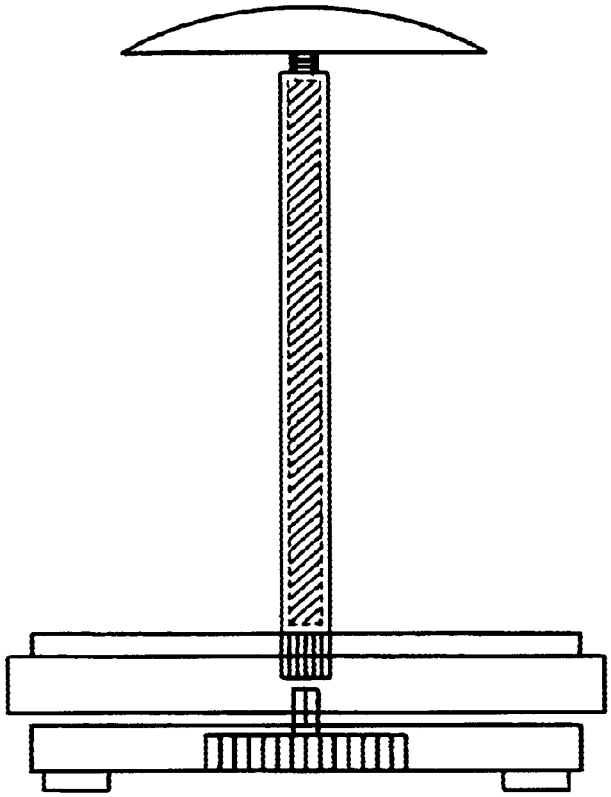
FIG. 3B illustrates a side view of the plate member inserted into rod.

Referring to FIG. 3B, the upper end of rod (225) is adapted to receive support peg (375). In the illustrated embodiment, the upper end of rod (225) is hollow and cut to correspond to the structure of support peg (275). Support peg (375) is inserted into the upper end of rod (225) and supported by rod (225). Referring back to FIG. 1, plate member (370) overlays the arranged puzzle pieces of the innermost and outermost layer. The dome shaped plate member (370) and the puzzle pieces of the innermost layer and the outermost layer are arranged to form the pod shaped structure illustrated in FIG. 1.

Figure 5A:
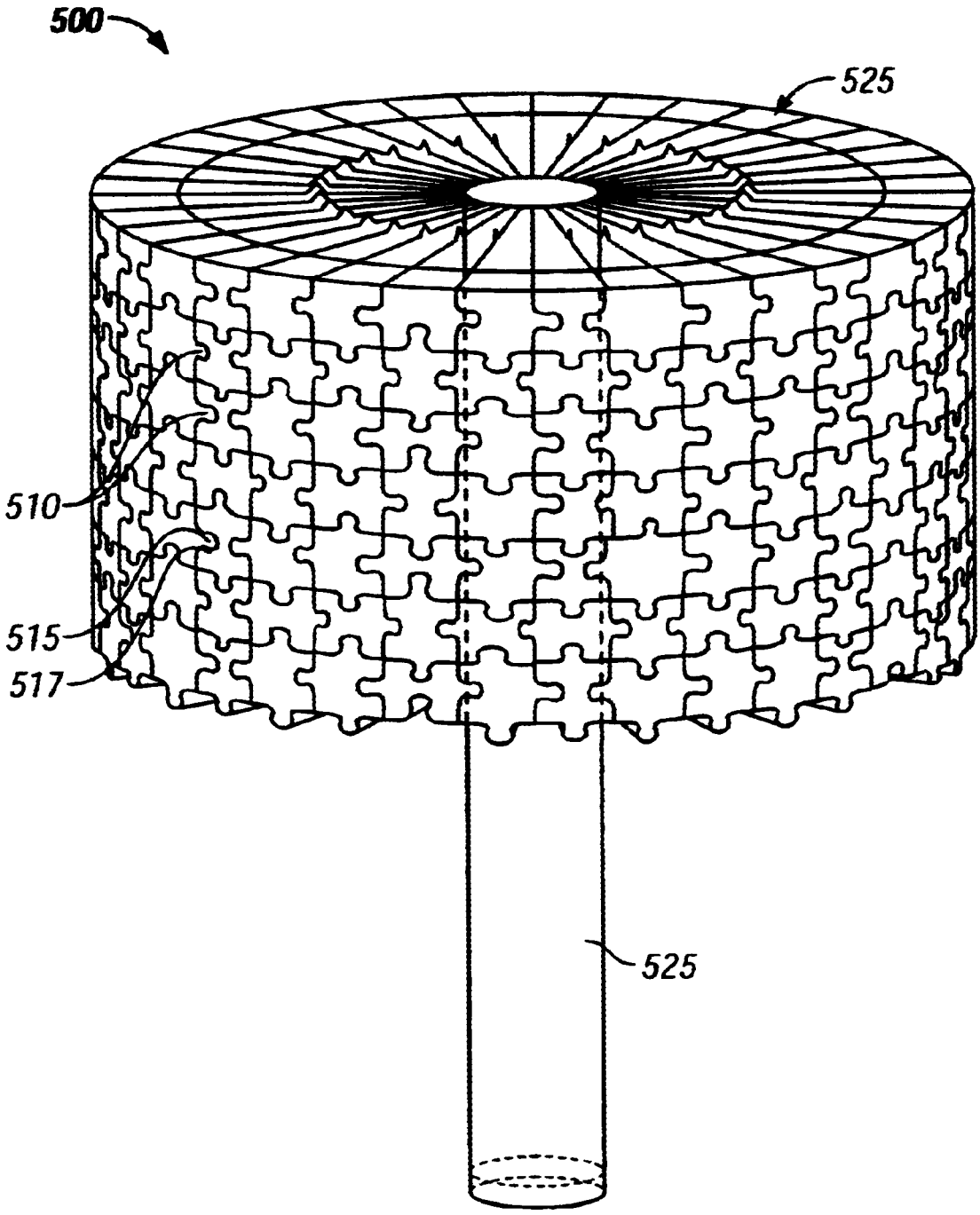
FIG. 5A illustrates a cross-sectional and top view of the geometrical structure formed by interlocking means.
Figure 5:
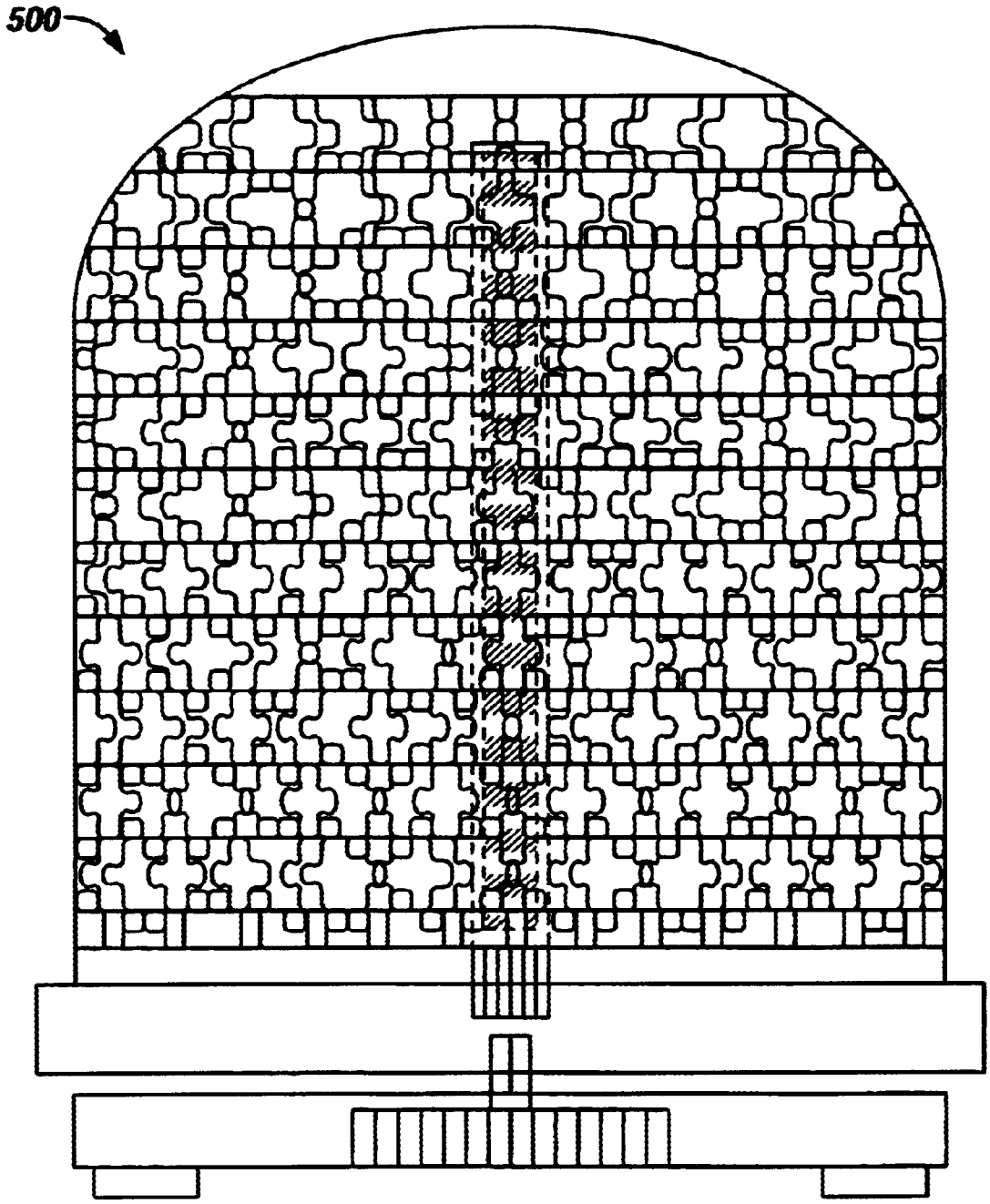
FIG. 5 is a side view of an alternative embodiment of the present invention using interlocking means.

Referring now to FIG. 5, there is illustrated an alternative embodiment of the present invention. The geometric structure (500) shown in FIG. 5, also includes an innermost layer and the outermost layer. In the illustrated embodiment, the puzzle pieces within the innermost layer (510) are interlocked together and the puzzle pieces of the outermost layer (520) are interlocked together.

Referring now to FIG. 5A, in this kind of embodiment, the side planes of each puzzle piece are equipped with interlocking means (510). The interlocking means (510) can consist of a flange (515) on one side plane of one puzzle piece and a mating slot (517) on another side plane of another puzzle piece.

In the illustrated embodiment shown in FIG. 5, geometric structure (500) is composed of a plurality of segments. Each segment spans the height of rod (525). Each segment further includes an innermost layer section and a corresponding outermost layer section. Additionally, each section of each segment is concentrically located around rod (525).

In order to construct the pod shape geometric structure (500) shown in FIG. 5, each segment starting from the bottom of the base to the top of the rod is arranged into a circular shape geometric figure surrounding rod (525). The total diameter of each segment from the base to the top of the rod (525) is adapted to in size to create the pod shaped structure. In alternative embodiments of geometric structure (500), the diameter of each segment of each layer would have to be adapted to correspond to the shape of the alternative embodiment.

In the illustrated embodiment in FIG. 5A, each segment is constructed starting with the innermost layer section (520) and then the corresponding outermost section (522) is constructed. In this kind of embodiment, the half-circle recess of each puzzle piece of the innermost layer section (520) is seated upon the mid-section of rod (525). Then, the side planes of each puzzle piece in the innermost layer section (520) are interlocked into a solid three dimensional circular geometrical structure. Secondly, each puzzle piece of the outermost layer section (522) can interlock or seat upon the back plane of a puzzle piece of the innermost layer section (520). Then, the side planes of each puzzle piece in the outermost layer section (522) are interlocked into a solid three dimensional geometrical circular structure. As the innermost section and the outermost section of each segment are constructed the pod shaped geometric structure (500) is formed.

The present invention is a mentally challenging puzzle that can also be utilized as a novelty item. The flexibility of the present invention is the construction of the innermost layers and the outermost layers into various geometric structures. Additionally, the innermost layers can be made of various materials. For example, geometric structure (100) shown in FIG. 1 can be made of the following materials:

1. An innermost layer (wood); outermost layer (clear plastic)
2. Innermost layer (red plastic); outermost layer (clear plastic); and
3. Innermost layer (red plastic); outermost layer (green plastic).

In the present invention, when the innermost layer and the outermost layer are both made of a transparent or translucent material an aesthetic lighting effect can be created. In this configuration, the innermost layer and the outermost layer are first constructed into a predetermined geometric structure that sits upon the base (200). Next, the cover is placed over the constructed geometric structure with the edges of the cover firmly placed within the groove along top surface of the base (200). Then, while the base (200) rotates, a neon light illuminates through the rod into the layers creating a lighting effect through motion.

In alternative embodiments of the present invention where the innermost layer is made of a non-transparent material a neon light cannot illuminate through the rod. However, the rotating base (200) can create an aesthetic effect through motion. The arrangement of the materials used to make the inner most layer and the outermost layer in conjunction with the rotating base (200) makes the present invention a valued novelty item.

What is claimed is:

1. A puzzle apparatus comprising:

a base having a top surface;

an elongated rod being securely attached at a centrally located position on the top surface of the base;

an innermost layer having a first set of puzzle pieces, each puzzle piece being defined by a front plane and a rear plane, the front plane of each puzzle piece having a recess adapted to be seated upon the rod, and the first set of puzzle pieces being arranged into a first predetermined geometric shape;

an outermost layer having a second set of puzzle pieces, each puzzle piece being defined by a front plane and a rear plane, the front plane of each puzzle piece being adapted to seat upon the rear edge of each puzzle piece of the innermost layer, and the second set of puzzle pieces being arranged into a second predetermined geometric shape;

a solid three dimensional geometrical structure being formed from the first set of arranged puzzle pieces and the second set of arranged puzzle pieces, the geometrical structure being supported by the top surface of the base; and wherein the outermost layer is made of a transparent or a translucent material.

2. The apparatus of claim 1 further comprising a cover defining a frame completely encompassing the geometrical structure, the cover sitting upon the top surface of the base enclosing the geometric structure.

3. The apparatus of claim 2 further comprising;

a groove engraved along the top surface of the base outer peripheral edge;

the cover having a bottom edge with a shape corresponding to the groove; and the bottom edge of the cover sitting inside the groove, whereby the cover is held in a stationary position on the top surface of the base.

4. The apparatus of claim 1 wherein the innermost layer is made of a translucent or a transparent material.

5. The apparatus according to of claim 4 wherein the rod is made of a transparent or a translucent material.

6. The apparatus of claim 5 further comprising an electrically connected neon light situated inside of the rod.

7. The apparatus of claim 1 wherein the innermost layer is made of a material that is non-transparent and non-translucent.

8. The apparatus of claim 1 further comprising:

a rotating means for rotating the base in a circular motion; and the rotating means being connected underneath the base or situated inside the base.

9. The apparatus of claim 1 wherein the geometrical structure further comprises:

a plate member having a support peg connected underneath the plate member; and upper end of the rod adapted to receive the support peg such that the plate member overlays the arranged puzzle pieces of the innermost layer and the outermost layer.

10. The apparatus of claim 9 wherein the plate member is shaped like a dome.

11. The apparatus of claim 10 wherein the plate member, the first set of puzzle pieces, and the second set of puzzle pieces are arranged into a pod shape.

12. The apparatus of claim 1 wherein each puzzle piece in the first set of puzzle pieces and in the second set of puzzle pieces further comprises a plurality of side planes forming a polyhedron.

13. The apparatus of claim 12 wherein each side plane of each puzzle piece in the first set of puzzle pieces and in the second set of puzzle pieces is aligned adjacent to a corresponding side plane of another puzzle piece in its respective set, whereby the innermost layer and the outermost layer are stacked into the first predetermined geometric shape.

14. The apparatus of claim 12 wherein each side plane of each puzzle piece in the first set of puzzle pieces and in the second set of puzzle pieces have a means for interlocking with a corresponding side plane of another puzzle piece in its respective set, whereby the innermost layer and the outermost layer are interlocked into the second predetermined geometric shape.

15. The apparatus of claim 1, wherein the innermost layer and outermost layer further comprises:

a plurality of segments;

each segment having a innermost layer section and an outermost section;

the outermost layer section being formed for a subset of the second set of puzzle pieces;

the outermost layer section being formed for a subset of the second set of puzzle pieces;

and each section concentrically positioned around the rod.

16. A puzzle apparatus comprising:

a base having a top surface;

a rod having an upper end and a lower end, a mid-section being disposed between the upper end and the lower end, the lower end being connected to the top surface of the base; and an innermost layer having a first set of puzzle pieces, each puzzle piece being defined by a front plane and a rear plane, the front plane of each puzzle piece having a recess adapted to be seated upon the mid-section rod, and the first set of puzzle pieces being arranged into a first predetermined geometric shape;

a solid three dimensional geometrical structure being formed from the first set of arranged puzzle pieces and the second set of arranged puzzle pieces, the geometrical structure being supported by the top surface of the base;

a cover defining a frame completely encompassing the geometrical structure, the cover sitting upon the top surface of the base enclosing the geometrical structure; and the rotating means being connected underneath the base or situated inside the base.

17. The apparatus of claim 16 further comprising:

a groove engraved along the top surface of the base outer peripheral edge;

the cover having a bottom edge with a shape corresponding to the groove; and the bottom edge of the cover sitting inside the groove, whereby the cover is held in a stationary position on the top surface of the base.

18. The apparatus of claim 16 wherein the outermost layer is made of a transparent of translucent material.

19. The apparatus of claim 18 wherein the innermost layer is made of a translucent or transparent material.

20. The apparatus according to of claim 19 wherein the rod is made of transparent or translucent material.

21. The apparatus of claim 20 further comprising an electrically connected neon light situated inside the rod.

22. The apparatus of claim 18 wherein the innermost layer is made of a material that is non-transparent and non-translucent.

23. The apparatus of claim 16 wherein the geometrical structure further comprises:

a plate member having a support peg connected underneath the plate member; and the upper end of the rod adapted to receive the support peg such that the plate member overlays the arranged puzzle pieces of the innermost layer and the outermost layer.

24. The apparatus of claim 23 wherein the plate member is shaped like a dome.

25. The apparatus of claim 24 wherein the plate member, the first set of puzzle pieces, and the second set of puzzle pieces are arranged into a pod shape.

26. The apparatus of claim 16 wherein each puzzle piece in the first set of puzzle pieces and in the second set of puzzle pieces further comprises a plurality of side planes forming a polyhedron.

27. The apparatus of claim 26 wherein each side plane of each puzzle piece in the first set of puzzle pieces and in the second set of puzzle pieces is aligned adjacent to a corresponding side plane of another puzzle piece in its respective set, whereby the innermost layer and the outermost layer are stacked into the first predetermined geometric shape.

28. The apparatus of claim 26 wherein each puzzle piece in the first set of of puzzle pieces and in the second set of puzzle pieces have a means for interlocking with a corresponding side plane of another puzzle piece in its respective set, whereby the innermost layer and the outermost layer are interlocked into the second predetermined geometric shape.

29. The apparatus of claim 16 wherein the innermost layer and the outermost layer further comprises:

a plurality of segments;

each segment having an innermost layer section and an outermost layer section;

the innermost layer section being formed for a subset of the first set of puzzle pieces;

the outermost layer section being formed for a subset of the second set of puzzle pieces;

and each section concentrically positioned around the rod.

30. A puzzle apparatus comprising:

a base having a top surface;

an elongated rod being securely attached at a centrally located position on the top surface of the base;

an innermost layer having a first set of puzzle pieces, each puzzle piece being defined by a front plane and a rear plane, the front plane of each puzzle piece having a recess adapted to be seated upon the rod, and the first set of puzzle pieces being arranged into a first predetermined geometric shape;

an outermost layer having a second set of puzzle pieces, each puzzle piece being defined by a front plane and a rear plane, the front plane of each puzzle piece being adapted to seat upon the rear edge of each puzzle piece of the innermost layer, and the second set of puzzle pieces being arranged into a second predetermined geometric shape;

a solid three dimensional geometrical structure being formed from the first set of arranged puzzle pieces and the second set of arranged puzzle pieces, the geometrical structure being supported by the top surface of the base; and the innermost layer section and the outermost layer section further comprises:

a plurality of segments;

each segment having a innermost layer section and an outermost section;

the outermost layer section being formed for a subset of the second set of puzzle pieces;

the outermost layer section being formed for a subset of the second set of puzzle pieces;

and each section concentrically positioned around the rod.

31. The apparatus of claim 20 further comprising a cover defining a frame completely encompassing the geometrical structure, the cover sitting upon the top surface of the base enclosing the geometric structure.

32. The apparatus of claim 31 further comprising;

a groove engraved along the top surface of the base outer peripheral edge; the cover having a bottom edge with a shape corresponding to the groove; and the bottom edge of the cover sitting inside the groove, whereby the cover is held in a stationary position on the top surface of the base.

33. The apparatus of claim 30 wherein the outermost layer is made of a transparent or a translucent material.

34. The apparatus of claim 33 wherein the innermost layer is made of a translucent or a transparent material.

35. The apparatus according to of claim 34 wherein the rod is made of a transparent or a translucent material.

36. The apparatus of claim 35 further comprising an electrically connected neon light situated inside of the rod.

37. The apparatus of claim 33 wherein the innermost layer is made of a material that is non-transparent and non-translucent.

38. The apparatus of claim 30 further comprising:

a rotating means for rotating the base in a circular motion; and the rotating means being connected underneath the base or situated inside the base.

39. The apparatus of claim 30 wherein the geometrical structure further comprises:

a plate member having a support peg connected underneath the plate member; and the upper end of the rod adapted to receive the support peg such that the plate member overlays the arranged puzzle pieces of the innermost layer and the outermost layer.

40. The apparatus of claim 39 wherein the plate member is shaped like a dome.

41. The apparatus of claim 40 wherein the plate member, the first set of puzzle pieces, and the second set of puzzle pieces are arranged into a pod shape.

42. The apparatus of claim 30 wherein each puzzle piece in the first set of puzzle pieces and in the second set of puzzle pieces further comprises a plurality of side planes forming a polyhedron.

43. The apparatus of claim 42 wherein each side plane of each puzzle piece in the first set of puzzle pieces and in the second set of puzzle pieces is aligned adjacent to a corresponding side plane of another puzzle piece in its respective set, whereby the innermost layer and the outermost layer are stacked into the first predetermined geometric shape.

44. The apparatus of claim 42 wherein each side plane of each puzzle piece in the first set of puzzle pieces and in the second set of puzzle pieces have a means for interlocking with a corresponding side plane of another puzzle piece in its respective set, whereby the innermost layer and the outermost layer are interlocked into the second predetermined geometric shape.

* * * * *